US006933908B1

(12) United States Patent
Mirabueno

(10) Patent No.: US 6,933,908 B1
(45) Date of Patent: Aug. 23, 2005

(54) PROTECTIVE COVER FOR SATELLITE DISHES

(76) Inventor: Epher T. Mirabueno, 8820 7th Ave. South, Seattle, WA (US) 98108

( * ) Notice: Subject to any disclaimer, the term of this patent is extended or adjusted under 35 U.S.C. 154(b) by 0 days.

(21) Appl. No.: 10/984,661

(22) Filed: Nov. 10, 2004

(51) Int. Cl.[7] ..... H01Q 1/42
(52) U.S. Cl. ..... 343/872; 343/DIG. 2
(58) Field of Search ..... 343/872, 757, 343/758, 761, DIG. 2; H01Q 1/42

(56) References Cited

U.S. PATENT DOCUMENTS 3,351,947 A 11/1967 Hart
3,757,698 A * 9/1973 Jacobson ..... 244/131
3,911,441 A * 10/1975 Stein ..... 343/709
4,198,639 A * 4/1980 Killion ..... 343/727
4,804,972 A 2/1989 Schudel
5,406,294 A 4/1995 Silvey et al.
5,528,253 A 6/1996 Franklin
5,815,125 A 9/1998 Kelly et al.
6,191,753 B1 2/2001 Ellis et al.
6,351,249 B1 * 2/2002 Wolfe, Jr. ..... 343/882

* cited by examiner

*Primary Examiner*—Hoanganh Le

(57) ABSTRACT

A protective cover for satellite dishes includes a rigid mounting plate having a planar top surface provided with an annular notch that is recessed into the mounting plate top surface and a plurality of apertures spaced inwardly of the notch. The cover further includes a dome section including an integrally disposed lip portion attachable to the mounting plate for housing the satellite dish therein. The dome section is formed from transparent fiberglass. A first plurality of fastening members are threadably mated through the mounting plate apertures. A mechanism is included for contemporaneously rotating the satellite dish and a selected portion of the dome section.

15 Claims, 4 Drawing Sheets

PROTECTIVE COVER FOR SATELLITE DISHES

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a protective cover and, more particularly, to a protective cover for satellite dishes for protecting such satellite dishes from inclement weather conditions.

2. Prior Art

Digital satellite communications systems employing digital television signals in the Ku microwave band (12 GHz) are increasingly popular for a number of reasons but principally because the frequencies employed allow small aperture antenna systems on the receiving end. Such small aperture receiving systems are highly desirable for home use. In the art of digital satellite dishes, a commonly constructed dish includes a support, a dish mounted on the support, and a feeder horn mounted on the support in a position where the feeder horn extends generally in front of and perpendicular with respect to the dish.

The use of such high frequency signals increases the chance that these signals will be refracted or absorbed by moisture in the atmosphere as they propagate from the satellite to the receiving antenna. These systems are designed for a given amount of signal attenuation due to such interference, but excessive signal attenuation can result in an inadequate signal at the receiving location. Accordingly, when localized precipitation causes signal attenuation beyond that for which the system was designed, the subscribers may experience what is called rain fade and eventually lose the transmitted signal entirely.

Furthermore, the feeder horn of the satellite dish is a particularly convenient structure for birds to land thereon. This results in the bird or its excrement interfering with the digital signal reception, thereby preventing the user of the satellite dish from receiving the digital signal, i.e., the user does not receive the signal. Other environmental elements, such as strong winds, ice and snow, when moving or being deposited on the feeder horn, or on the dish itself, can interfere with the digital signal reception as well.

Accordingly, a need remains for a protective cover for satellite dishes in order to overcome the above-noted shortcomings. The present invention satisfies such a need by providing a dish cover that is easy to install, results in time savings and imparts a sense of comfort to a user knowing that their satellite dish and signal is protected from the elements. Such a satellite dish cover provides a complete protective dome that fully encapsulates various types of satellite dishes to permit satellite operation in all weather situations.

BRIEF SUMMARY OF THE INVENTION

In view of the foregoing background, it is therefore an object of the present invention to provide a protective cover for satellite dishes. These and other objects, features, and advantages of the invention are provided by an apparatus for protecting a satellite dish from inclement weather conditions.

The apparatus includes a rigid mounting plate removably securable to a support surface. Such a mounting plate has a substantially planar top surface provided with a unitary and continuous annular notch extending adjacent to a circumference thereof. The notch is recessed into the mounting plate top surface. Such a mounting plate is provided with a plurality of apertures spaced inwardly of the notch. The mounting plate is preferably further provided with a plurality of mounting holes for effectively receiving a second plurality of fastening members therethrough. Such mounting holes are spaced outwardly from the notch so that a user can advantageously remove the second plurality of fastening members from the mounting plate without requiring prior removal of the dome section.

The present invention further includes a dome section removably attachable to the mounting plate. Such a dome section is sized and shaped for effectively housing the satellite dish therein and includes an integrally disposed lip portion extending downwardly therefrom for being slidably positioned into the notch during installation procedures. The dome section is formed from transparent fiberglass and extends upwardly from the mounting plate. Of course, alternate suitable materials may be used for the dome section construction, as is well known to an individual of ordinary skill in the art.

The dome section preferably includes a base portion that has a substantially planar bottom surface integral with the lip portion. Such a base portion further has an open top end portion provided with a threaded inner surface extending about a circumference thereof. The dome further includes a lid portion that has an open bottom end portion provided with a threaded outer surface extending about a circumference thereof. Such a lid portion is conveniently and threadably mateable with the base portion.

The dome section may further be provided with a plurality of slots disposed above the mounting plate apertures such that the slots become vertically aligned therewith respectively. Such slots cooperate with the notch, conveniently guiding the base portion and the satellite dish along a predetermined radial path partially defined by a length of the slots respectively. The slots are formed in the base portion and have elongated arcuate shapes. Such a base portion is rotatably positionable along a length of the slots so that a user can advantageously selectively position the satellite dish without having to detach the dome section from the mounting plate.

A first plurality of fastening members are threadably mated through the mounting plate apertures and the slots such that the dome section and the mounting plate advantageously form a substantially water-tight relationship.

A mechanism is included for contemporaneously rotating the satellite dish and a selected portion of the dome section along a path partially defined by the notch. Such a positioning mechanism preferably includes a raised flange portion integral with the base portion and extending upwardly therefrom. The flange portion defines an opening therebetween. A support insert is axially positioned within the flange portion opening and provided with a threaded inner surface. Such an insert has opposed end portions radially flared outwardly therefrom for maintaining surface area contact with the flange portion during operating conditions. A set screw is threadably coupled to the insert and engaged with a bottom portion of the satellite dish.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
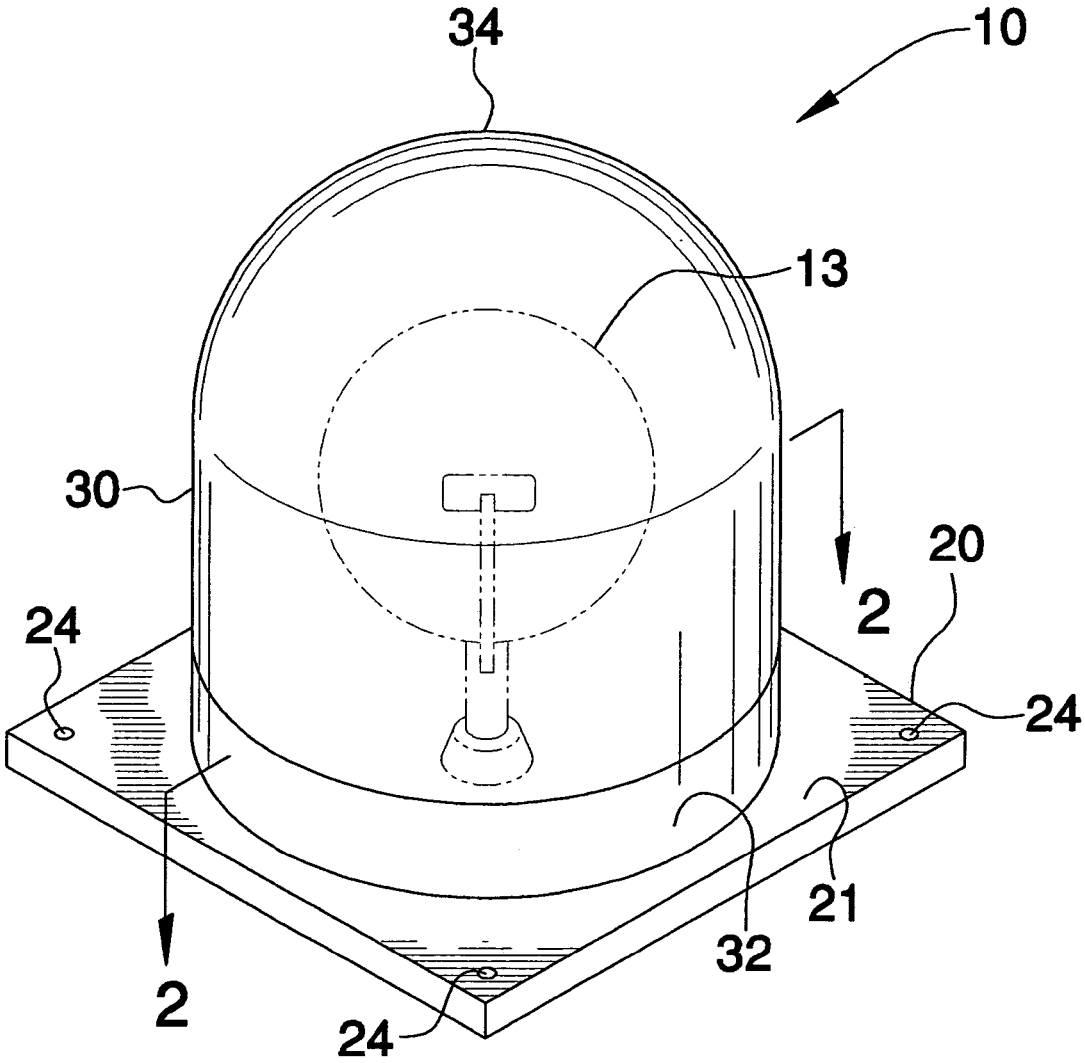
FIG. 1 is a perspective view showing a protective cover for satellite dishes, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide a protective cover for satellite dishes. It should be understood that the apparatus 10 may be used to protect many different types of satellite dishes and should not be limited to only television satellite dishes.

Figure 3:
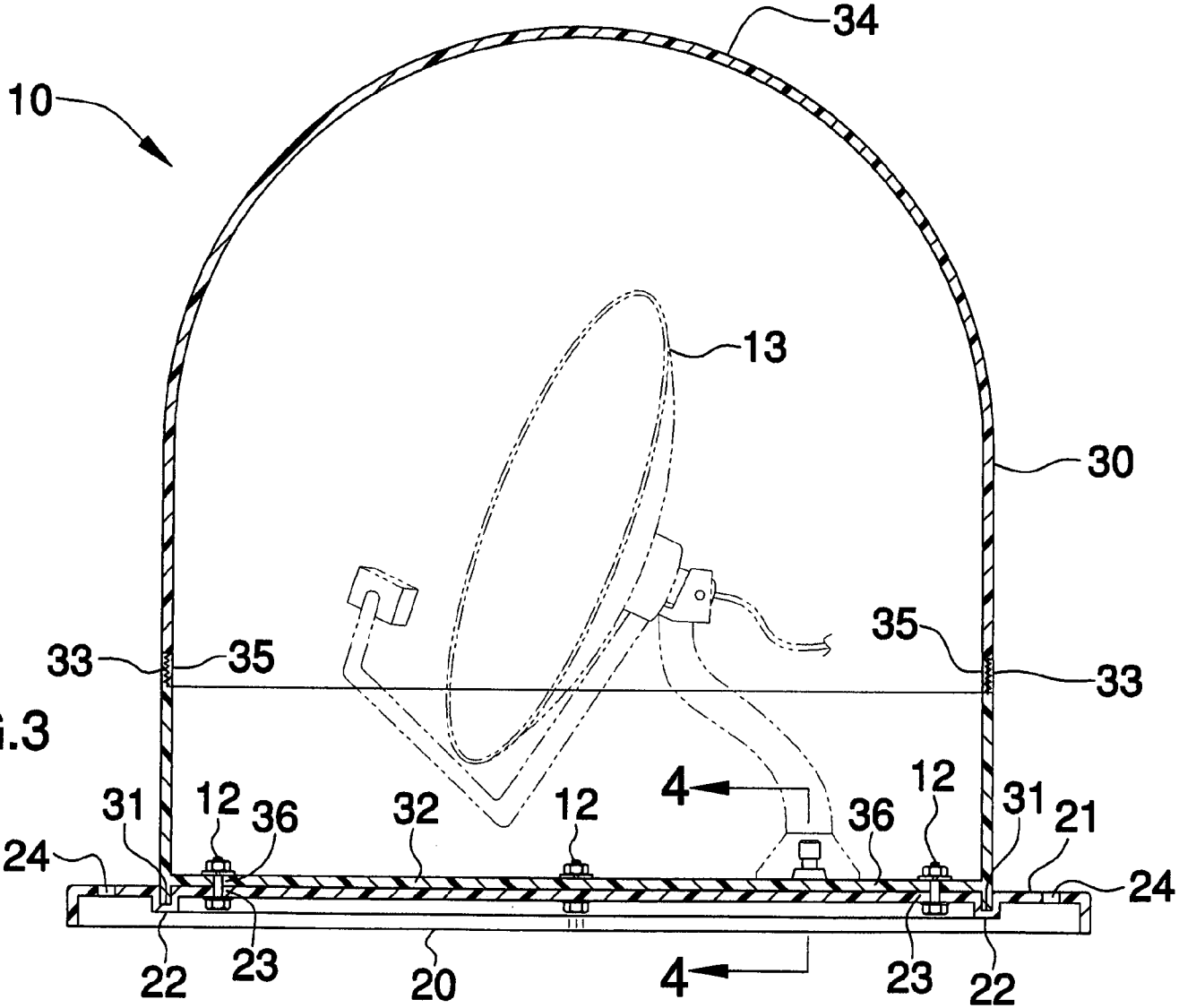
FIG. 3 is a cross-sectional view of the apparatus shown in FIG. 2, taken along line 3—3.

Referring initially to FIGS. 1 and 3, the apparatus 10 includes a rigid mounting plate 20 removably securable to a support surface that advantageously provides a sturdy surface for mounting a satellite dish 13. Such a mounting plate 20 has a substantially planar top surface 21 provided with a unitary and continuous annular notch 22 extending adjacent to a circumference thereof. The notch 22 is recessed into the mounting plate top surface 21. Such a mounting plate 20 is provided with a plurality of apertures 23 spaced inwardly of the notch 22. The mounting plate 20 is further provided with a plurality of mounting holes 24 for effectively receiving a second plurality of fastening members (not shown) therethrough. Such mounting holes 24 are spaced outwardly from the notch 22 so that a user can advantageously remove the second plurality of fastening members 11 from the mounting plate 20 without necessitating prior removal of the dome section 30 (described herein below).

Figure 2:
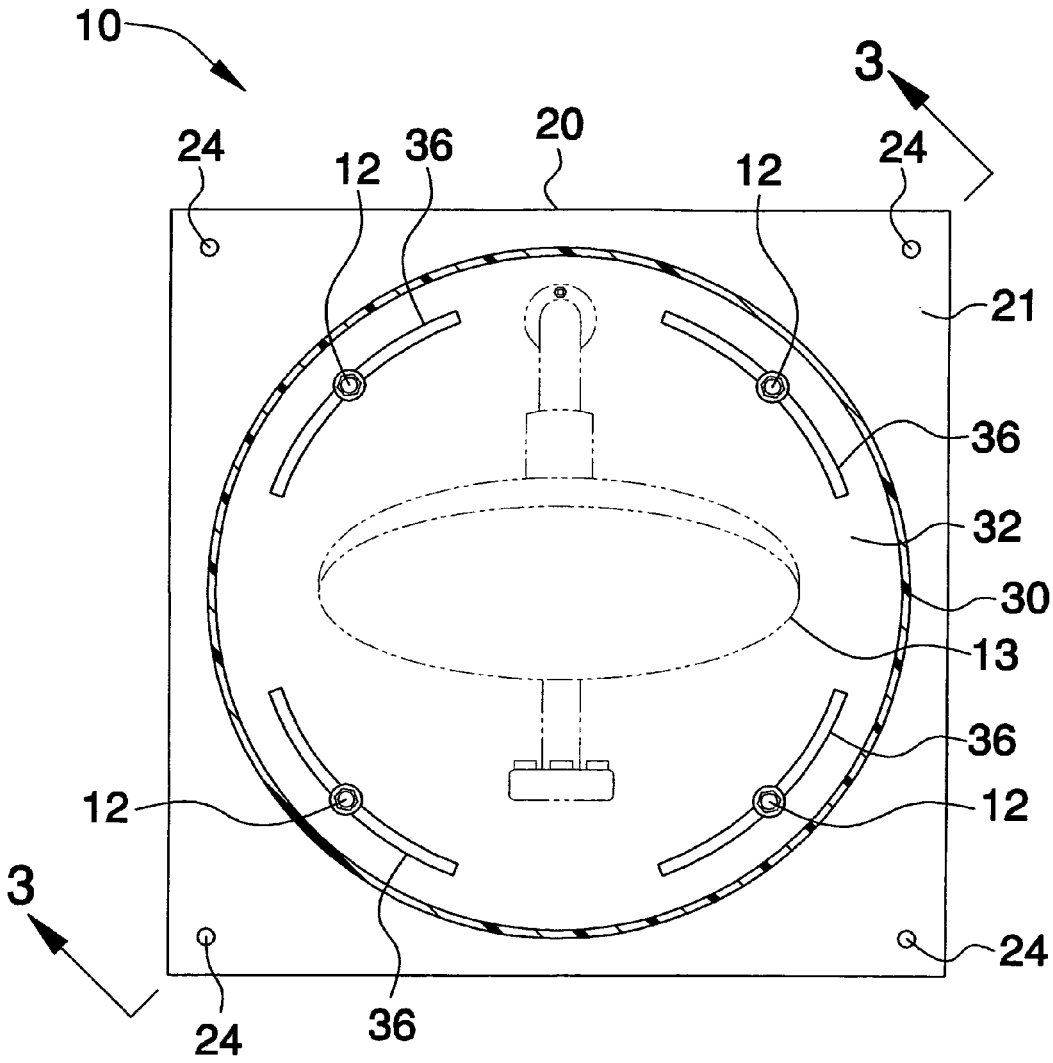
FIG. 2 is a cross-sectional view of the apparatus shown in FIG. 1, taken along line 2—2.

Referring to FIGS. 1 through 3, the present invention further includes a dome section 30 removably attachable to the mounting plate 20. Such a dome section 30 is sized and shaped for effectively housing the satellite dish 13 therein and further includes an integrally disposed lip 31 portion extending downwardly therefrom for being slidably positioned into the notch 22 during installation procedures, thus advantageously preventing horizontal movement of the dome section 30. The dome section 30 is formed from transparent fiberglass and extends upwardly from the mounting plate.

Of course, alternate suitable materials may be used for the dome section 30 construction, as is well known to an individual of ordinary skill in the art. Such a dome section 30 conveniently protects the satellite dish 13 from weather elements such as rain, ice and snow that usually interfere with the signal reception of the satellite dish 13. The dome section 30 further prevents animals, such as birds and squirrels, from shifting the satellite dish 13 angle and thereby preventing the dish 13 from properly receiving its signal. Readjustment of the dish 13 after such shifting thereof is usually very energy and time consuming, not to mention frustrating.

Figure 4:
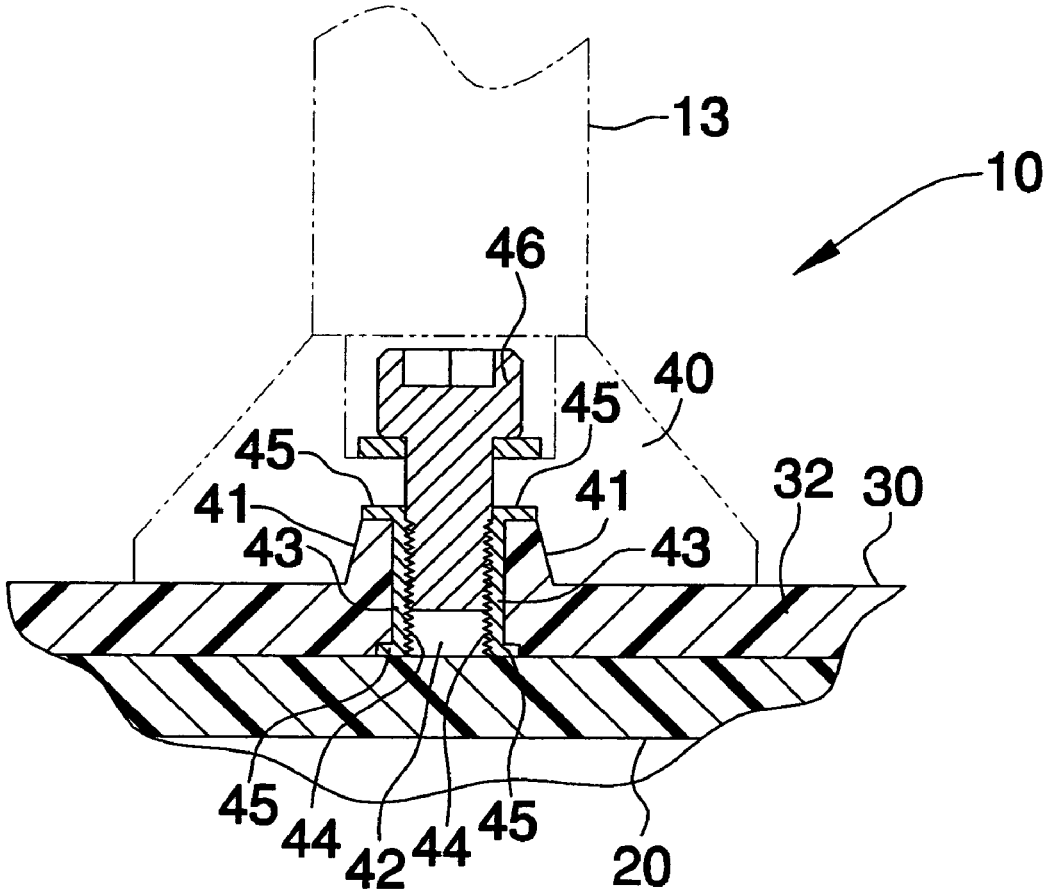
FIG. 4 is a cross-sectional view of the support insert shown in FIG. 3, taken along line 4—4.

Referring to FIGS. 2 through 4, the dome section 30 includes a base portion 32 that has a substantially planar bottom surface integral with the lip portion 31. Such a base portion 32 further has an open top end portion provided with a threaded inner surface 33 extending about a circumference thereof. The dome section 30 further includes a lid portion 34 that has an open bottom end portion provided with a threaded outer surface 35 extending about a circumference thereof. Such a lid portion 34 is conveniently and threadably mateable with the base portion 32 such that the satellite dish 13 is advantageously completely covered and protected from external elements and other interferences. The lid portion 34 further conveniently allows for easy access to the satellite dish 13 in the event that maintenance or repair is required.

Referring to FIG. 2, the dome section 30 is further provided with a plurality of slots 36 disposed above the mounting plate apertures 23 such that the slots 36 become vertically aligned therewith respectively. Such slots 36 cooperate with the notch 22, conveniently guiding the base portion 32 and the satellite dish 13 along a predetermined radial path partially defined by a length of the slots 36 respectively. The slots 36 are formed in the base portion 32 and have elongated arcuate shapes. Of course, slots 36 of alternate shapes may also be employed as is obvious to a person of ordinary skill in the art. Such a base portion 32 is rotatably positionable along a length of the slots 36 so that a user can advantageously selectively position the satellite dish 13 without having to detach the dome section 30 from the mounting plate 20, thus saving the user a considerable amount of time and energy.

Referring to FIGS. 2 and 3, a first plurality of fastening members 12 are threadably mated through the mounting plate apertures 23 and the slots 36 such that the dome section 30 and the mounting plate 20 advantageously form a substantially water-tight relationship. Such a water tight seal conveniently protects the satellite dish 13 from damaging elements in the air and from exposure to water, thus ensuring proper functioning of the dish 13.

Referring to FIG. 4, a mechanism 40 is included for contemporaneously rotating the satellite dish 13 and a selected portion of the dome section 30 along a path partially defined by the notch 22. Such a positioning mechanism 40 includes a raised flange portion 41 integral with the base portion 32 and extending upwardly therefrom. The flange portion 41 defines an opening 42 therebetween. A support insert 43 is axially positioned within the flange portion opening 42 and provided with a threaded inner surface 44. Such an insert 43 has opposed end portions 45 radially flared outwardly therefrom for maintaining surface area contact with the flange portion 41 during operating conditions.

A set screw 46 is threadably coupled to the insert 43 and engaged with a bottom portion of the satellite dish 13. The set screw 46 conveniently fastens the satellite dish 13 to the base portion 32, thus allowing the simultaneous radial adjustment of the base portion 32 and the satellite dish 13. This feature saves the user a considerable amount of time and energy during installation when the satellite dish 13 must be rotated for optimum signal reception.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for protecting a satellite dish from inclement weather conditions, said apparatus comprising:

a mounting plate removably securable to a support surface, said mounting plate having a substantially planar top surface provided with a unitary and continuous notch extending adjacent a circumference thereof, said notch being recessed into said mounting plate top surface, said mounting plate being provided with a plurality of apertures spaced inwardly of the notch; and a dome section removably attachable to said mounting plate and being sized and shaped for housing the satellite dish therein, said dome section including an integrally disposed lip portion extending downwardly therefrom for being slidably positioned into the notch during installation procedures;

a first plurality of fastening members threadably mated through said mounting plate apertures such that said dome section and said mounting plate form a substantially water-tight relationship; and positioning means for contemporaneously rotating the satellite dish and a selected portion of said dome section along a path partially defined by the notch.

2. The apparatus of claim 1, wherein said dome section comprises:

a base portion having a substantially planar bottom surface integral with said lip portion, said base portion further having an open top end portion provided with a threaded inner surface extending about a circumference thereof; and a lid portion having an open bottom end portion provided with a threaded outer surface extending about a circumference thereof, said lid portion being threadably mateable with said base portion.

3. The apparatus of claim 2, wherein said dome section is provided with a plurality of slots and disposed above said mounting plate apertures such that the slots become vertically aligned therewith respectively, said slots for cooperating with the notch for guiding said base portion and the satellite dish along a predetermined radial path partially defined by a length of said slots respectively.

4. The apparatus of claim 1, wherein said mounting plate is further provided with a plurality of mounting holes for receiving a second plurality of fastening members therethrough, the mounting holes be spaced outwardly from the notch so that a user can remove said second plurality of fastening members from said mounting plate without necessitating prior removal of said dome section.

5. The apparatus of claim 2, wherein said positioning means comprises:

a raised flange portion integral with said base portion and extending upwardly therefrom, said flange portion defining an opening therebetween;

a support insert axially positioned within the flange portion opening and providing with a threaded inner surface, said insert having opposed end portions radially flared outwardly therefrom for maintaining surface area contact with said flange portion during operating conditions; and a set screw threadably coupled to said insert and engaged with a bottom portion of the satellite dish;

wherein the slots are formed in said base portion and have elongated arcuate shapes, said base portion being rotatably positionable along a length of the slots so that a user can selectively position the satellite dish without having to detach said dome section from said mounting plate.

6. An apparatus for protecting a satellite dish from inclement weather conditions, said apparatus comprising:

a mounting plate removably securable to a support surface, said mounting plate having a substantially planar top surface provided with a unitary and continuous notch extending adjacent a circumference thereof, said notch being recessed into said mounting plate top surface, said mounting plate being provided with a plurality of apertures spaced inwardly of the notch; and a dome section removably attachable to said mounting plate and being sized and shaped for housing the satellite dish therein, said dome section including an integrally disposed lip portion extending downwardly therefrom for being slidably positioned into the notch during installation procedures, said dome section being formed from transparent fiberglass;

a first plurality of fastening members threadably mated through said mounting plate apertures such that said dome section and said mounting plate form a substantially water-tight relationship; and positioning means for contemporaneously rotating the satellite dish and a selected portion of said dome section along a path partially defined by the notch.

7. The apparatus of claim 6, wherein said dome section comprises:

a base portion having a substantially planar bottom surface integral with said lip portion, said base portion further having an open top end portion provided with a threaded inner surface extending about a circumference thereof; and a lid portion having an open bottom end portion provided with a threaded outer surface extending about a circumference thereof, said lid portion being threadably mateable with said base portion.

8. The apparatus of claim 7, wherein said dome section is provided with a plurality of slots and disposed above said mounting plate apertures such that the slots become vertically aligned therewith respectively, said slots for cooperating with the notch for guiding said base portion and the satellite dish along a predetermined radial path partially defined by a length of said slots respectively.

9. The apparatus of claim 6, wherein said mounting plate is further provided with a plurality of mounting holes for receiving a second plurality of fastening members therethrough, the mounting holes be spaced outwardly from the notch so that a user can remove said second plurality of fastening members from said mounting plate without necessitating prior removal of said dome section.

10. The apparatus of claim 7, wherein said positioning means comprises:

a raised flange portion integral with said base portion and extending upwardly therefrom, said flange portion defining an opening therebetween;

a support insert axially positioned within the flange portion opening and providing with a threaded inner surface, said insert having opposed end portions radially flared outwardly therefrom for maintaining surface area contact with said flange portion during operating conditions; and a set screw threadably coupled to said insert and engaged with a bottom portion of the satellite dish;

wherein the slots are formed in said base portion and have elongated arcuate shapes, said base portion being rotatably positionable along a length of the slots so that a user can selectively position the satellite dish without having to detach said dome section from said mounting plate.

11. An apparatus for protecting a satellite dish from inclement weather conditions, said apparatus comprising:

a rigid mounting plate removably securable to a support surface, said mounting plate having a substantially planar top surface provided with a unitary and continuous annular notch extending adjacent a circumference thereof, said notch being recessed into said mounting plate top surface, said mounting plate being provided with a plurality of apertures spaced inwardly of the notch; and a dome section removably attachable to said mounting plate and being sized and shaped for housing the satellite dish therein, said dome section including an integrally disposed lip portion extending downwardly therefrom for being slidably positioned into the notch during installation procedures, said dome section being formed from transparent fiberglass, said dome section extending upwardly from said mounting plate;

a first plurality of fastening members threadably mated through said mounting plate apertures such that said dome section and said mounting plate form a substantially water-tight relationship; and positioning means for contemporaneously rotating the satellite dish and a selected portion of said dome section along a path partially defined by the notch.

12. The apparatus of claim 11, wherein said dome section comprises:

a base portion having a substantially planar bottom surface integral with said lip portion, said base portion further having an open top end portion provided with a threaded inner surface extending about a circumference thereof; and a lid portion having an open bottom end portion provided with a threaded outer surface extending about a circumference thereof, said lid portion being threadably mateable with said base portion.

13. The apparatus of claim 12, wherein said dome section is provided with a plurality of slots and disposed above said mounting plate apertures such that the slots become vertically aligned therewith respectively, said slots for cooperating with the notch for guiding said base portion and the satellite dish along a predetermined radial path partially defined by a length of said slots respectively.

14. The apparatus of claim 11, wherein said mounting plate is further provided with a plurality of mounting holes for receiving a second plurality of fastening members therethrough, the mounting holes be spaced outwardly from the notch so that a user can remove said second plurality of fastening members from said mounting plate without necessitating prior removal of said dome section.

15. The apparatus of claim 12, wherein said positioning means comprises:

a raised flange portion integral with said base portion and extending upwardly therefrom, said flange portion defining an opening therebetween;

a support insert axially positioned within the flange portion opening and providing with a threaded inner surface, said insert having opposed end portions radially flared outwardly therefrom for maintaining surface area contact with said flange portion during operating conditions; and a set screw threadably coupled to said insert and engaged with a bottom portion of the satellite dish;

wherein the slots are formed in said base portion and have elongated arcuate shapes, said base portion being rotatably positionable along a length of the slots so that a user can selectively position the satellite dish without having to detach said dome section from said mounting plate.

* * * * *